United States Patent [19]

Yeh et al.

[11] Patent Number: 5,014,479

[45] Date of Patent: May 14, 1991

[54] FLEXIBLE ASSEMBLING PARTITION MEANS

[76] Inventors: Chia-Luan Yeh; Ting-Kuo Chen, both of P.O. Box 10160, Taipei, Taiwan

[21] Appl. No.: 503,045

[22] Filed: Apr. 2, 1990

[51] Int. Cl.[5] ..... E04B 5/46; E04C 1/42

[52] U.S. Cl. ..... 52/308; 52/477; 52/656; 52/507; 52/511

[58] Field of Search ..... 52/234, 235, 127.6, 52/127.8, 474–477, 656, 507, 663, 589, 593, 488, 308; 174/48

[56] References Cited

U.S. PATENT DOCUMENTS

| | | | |
|---|---|---|---|
| 1,966,041 | 7/1934 | Nelson | 52/488 |
| 1,990,259 | 2/1935 | Walters | 52/242 |
| 2,163,454 | 6/1939 | Slick | 52/308 |
| 2,173,213 | 9/1939 | Maul | 52/308 |
| 2,260,178 | 10/1941 | Guignon | 52/761 |
| 3,086,629 | 4/1963 | Blitzer | 52/663 |
| 3,296,759 | 1/1967 | Pavlecka | 52/277 |
| 4,641,890 | 12/1986 | Szombathelyi | 52/574 |

FOREIGN PATENT DOCUMENTS

| | | | |
|---|---|---|---|
| 1243588 | 9/1960 | France | 52/475 |

*Primary Examiner*—James L. Ridgill, Jr.

[57] ABSTRACT

A flexible assembling partition system includes a plurality of octagonal block units assembled with one another, at least a sheathing frame member for covering all side extensions formed on each block unit, and a plurality of face members each face member embedded in each block unit serving as a finishing, decorative illuminative surface for each block unit, thereby forming a partition structure easily optionally assembled or disassembled.

12 Claims, 5 Drawing Sheets

FLEXIBLE ASSEMBLING PARTITION MEANS

BACKGROUND OF THE INVENTION

Even J. Pavlecka disclosed an interlocked hollow panel structure in his U.S. Pat. No. 3,296,759, which is assembled or erected of panel units by slidably inserted blocking keys from one open end of the structure and which can be disassembled for repair or relocation by withdrawing the keys. However, it may still have the following drawbacks:

1. The basic panel units 1, 2 are still larger plates, which should be made or pre-fabricated in a factory and should be further processed or cut adapted for use in a construction site, unsuitable for use in an office partition system which requires flexible, adjustable assembling or disassembling arrangements.

2. If for illuminating or decorative purpose, the panel 1 or 2 must be cut to form a light transmissive window or should be further printed or formed with a decorative figure on the panel to increase the finishing complexity or cost.

3. The stringers 3, 4 are not integrally combined with the panel 1, 2 during their production, thereby possibly increasing the production cost and installation inconvenience of a whole panel structure or system.

The present inventors have found the drawback of such a conventional panel structure, and invented the present flexible partition means.

SUMMARY OF THE INVENTION

The object of the present invention is to provide a flexible assembling partition system, including a plurality of octagonal block units assembled with one another, at least a sheathing frame member for covering all side extensions formed on each block unit, and a plurality of face members each face member embedded in each block unit serving as a finishing, decorative or illuminative surface for each block unit, thereby forming a partition structure easily and optionally assembled or disassembled.

DETAILED DESCRIPTION

Figure 1:
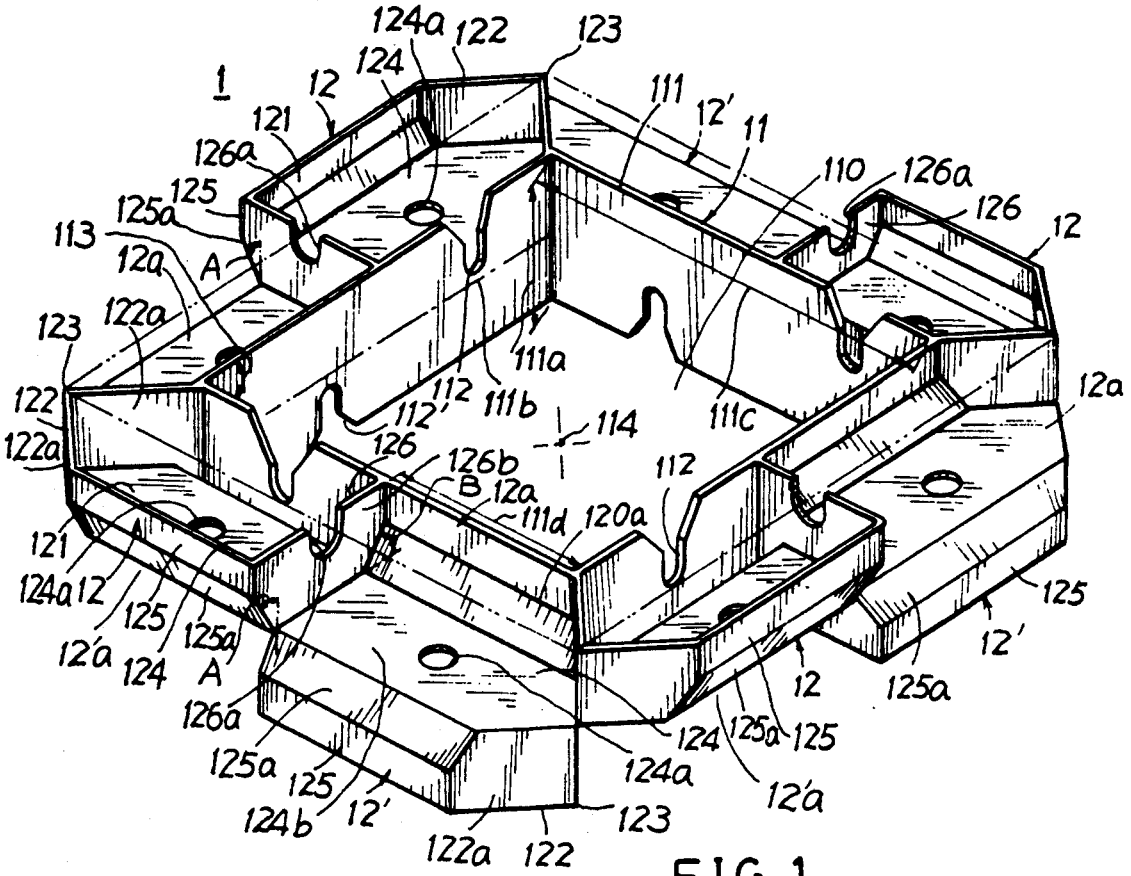
FIG. 1 is an illustration of the octagonal block unit of the present invention.

As shown in the figures, the present invention comprises a flexible assembling partition means comprised of a plurality of octagonal block units 1 assembled with one another, each block unit 1 being embedded with a face member 2 therein, and at least a sheathing frame member 3 provided for covering all side portions of the assembled block units 1. Each block unit 1 and face member 2 can be made by integral molding process, and each frame member 3 can be formed by extrusion molding process.

As shown in FIGS. 1–4, each octagonal block unit 1 includes: a central square portion 11 having four side walls 111 for forming a square and defining a central square hole 110 within the side walls 111, each side wall 111 having an upper side extension 12 and an upper recess 12*a* adjacent to the side extension 12 formed on an upper half portion of each side wall 111, and each side wall 111 having a lower side extension 12' having a same structure as that of the upper extension 12 and a lower recess 12'*a* adjacent to the lower side extension 12' formed on a lower half portion of each side wall 111. Each upper side extension 12 is interlaced with each lower side extension 12', whereas each upper recess 12*a* is interlaced with each lower recess 12'*a*. Each block unit 1 has a general octagonal shape from its top view.

Figure 2:
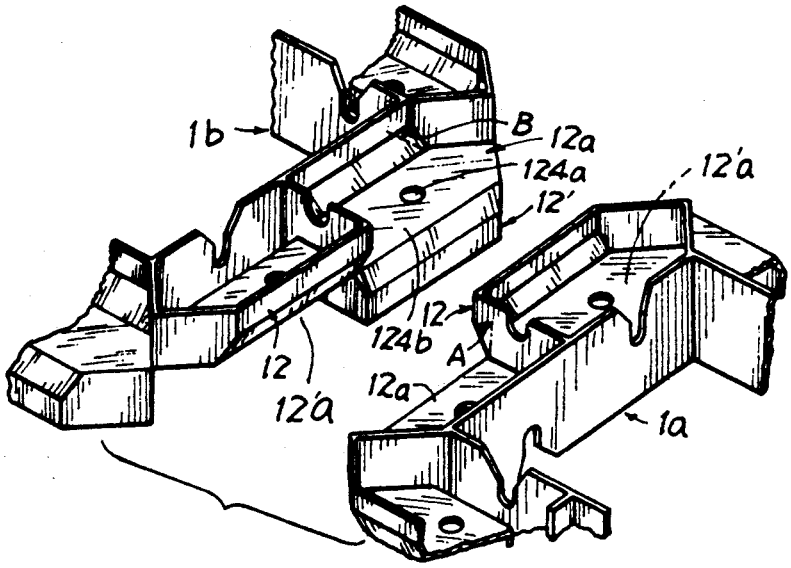
FIG. 2 shows an assembly of two neighboring block units in accordance with the present invention.

Each side extension 12 or 12' includes a hollow portion 121 having an opening facing upwardly (upper extension 12) or downwardly (lower extension 12'), a side wall plate 125 parallel to each side wall 111 of the square portion 11, a bottom plate 124 perpendicularly secured to the side wall 111, a right-angle triangle portion 122 formed at a right-angle portion 113 of the square portion 11 having an outer angled plate 122*a* defining an apex 123 on its outermost point shaped as an arrow direction and a partition plate 126 defining a central surface 126*b* adjacent to the recess 12*a* or 12*a'*. Such a central surface 126*b* is aligned with a central line between two half lengthes 111*d* of the side wall length 111*c*. The triangle portions 122 of all upper side extensions 12 are oriented clockwise about a diagonal center 114 of the square portion 11, whereas all triangle portions 122 of the lower side extensions 12' are oriented counter-clockwise opposite to the upper side extensions 12. Each side extension 12 is equivalent in dimension to each recess 12*a*, so that two adjacent block units 1*a*, 1*b* can be assembled with each other with each side extension 12 being engaged with each neighboring recess 12*a* as shown in FIG. 2.

Each recess 12*a* is formed with a sloping portion 120*a* having an acute angle B from a horizontal surface 124*b* formed on a bottom surface of the bottom plate 124 of each side extension 12' or 12. The horizontal surface 124*b* is coincided with a half height 111*b* of a height 111*a* of each side wall 111 of the square portion 11. At a central portion of the horizontal surface 124*a* of the bottom plate, a fixing hole 124*a* is formed therein so that two engaged block units can be combined by fixing a bolt through two holes 124*a*.

Each side extension 12 is formed with a sloping portion 125*a* intersecting the side wall plate 125 and the bottom plate 124 having an acute angle A to be engageable with angle B of the recess 12*a*. A notch 126*a* is formed in the partition plate 126 for directing a cable or a wire in an office upholstery. Each side wall 111 is formed with an upper notch 112 and a lower notch 112' therein.

Figure 3:
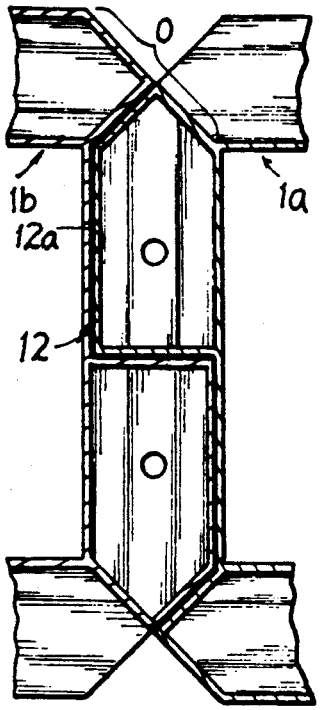
FIG. 3 is a top view showing the assembly of two block units of the present invention.
Figure 4:
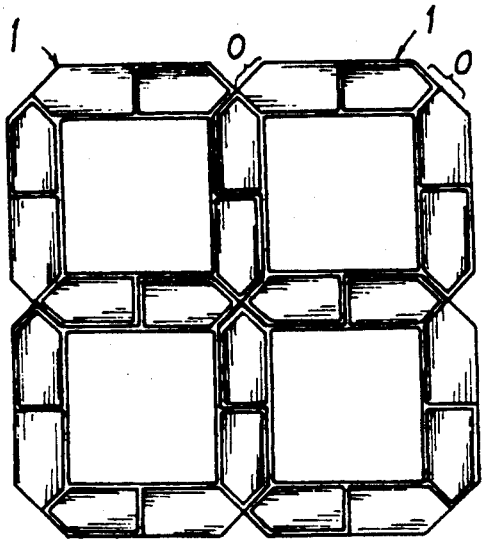
FIG. 4 is a top view illustration after assembling several block units of the present invention.
Figure 5:
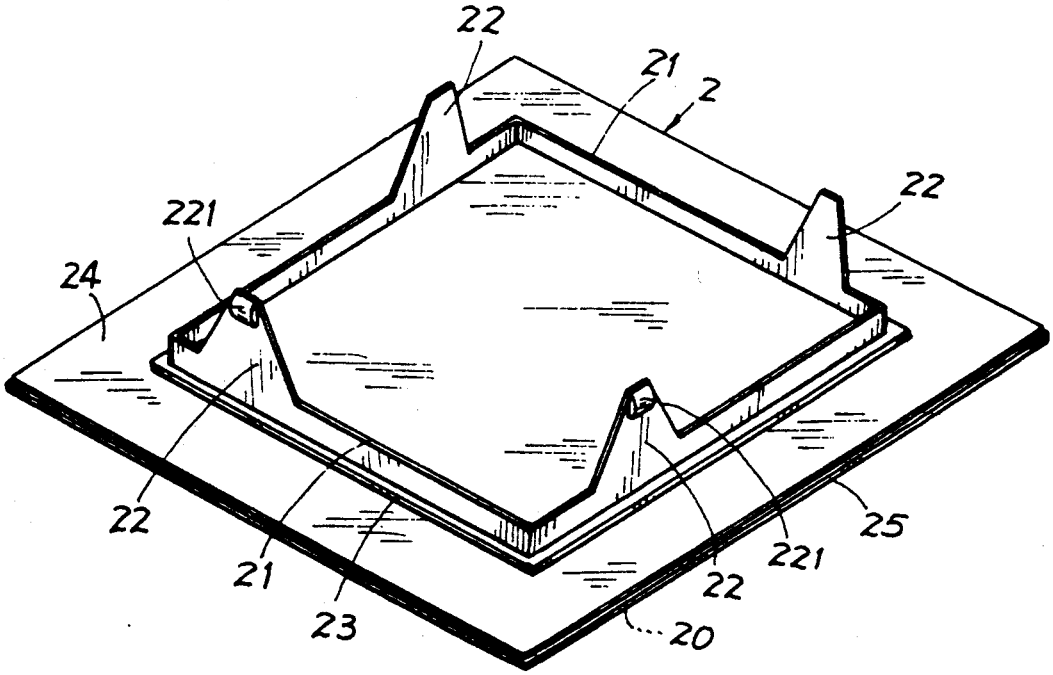
FIG. 5 is an illustration of a face member of the present invention.

After assembling two block units 1, each pair of side extensions 12, 12' are coupled as shown in FIGS. 3, 4 to commonly form a octagonal corner O. By this invention, any two adjacent block units 1 can be easily assembled by engaging each upper side extension 12 of one unit 1*a* with each upper recess 12*a* of another unit 1*b* or by engaging each lower recess 12'*a* of one unit 1*a* with each lower extension 12' of another unit 1*b*. A plurality of block units 1 can be optionally assembled for forming a gigantic structure for office partition, wall, cabinet uses.

Each block unit 1 is embedded with a face member 2 as shown in FIGS. 5, 6, 7, 8, in which each face member 2 includes a face plate 20 which may be coated with a finishing material, a leather, a polyurethane (PU) foam, or printed with decorative figure, or embedded with a transparent sheet (not shown) for light transmissive illuminating purpose; a square extension 21 formed on a central inside surface of the face plate 20 engageable with the four side walls 111 of the central square portion 11 having a plurality of lugs 22 protruding from the extension 21 each lug 22 formed with a protrusion 221 thereon for engaging each notch 112 or 112' formed in the side wall 111 for securing each face member 2 on each block unit 1, and a square flange 24 disposed around the square extension 21 for partially shielding the side extensions 12 of the block unit 1.

Figure 8:
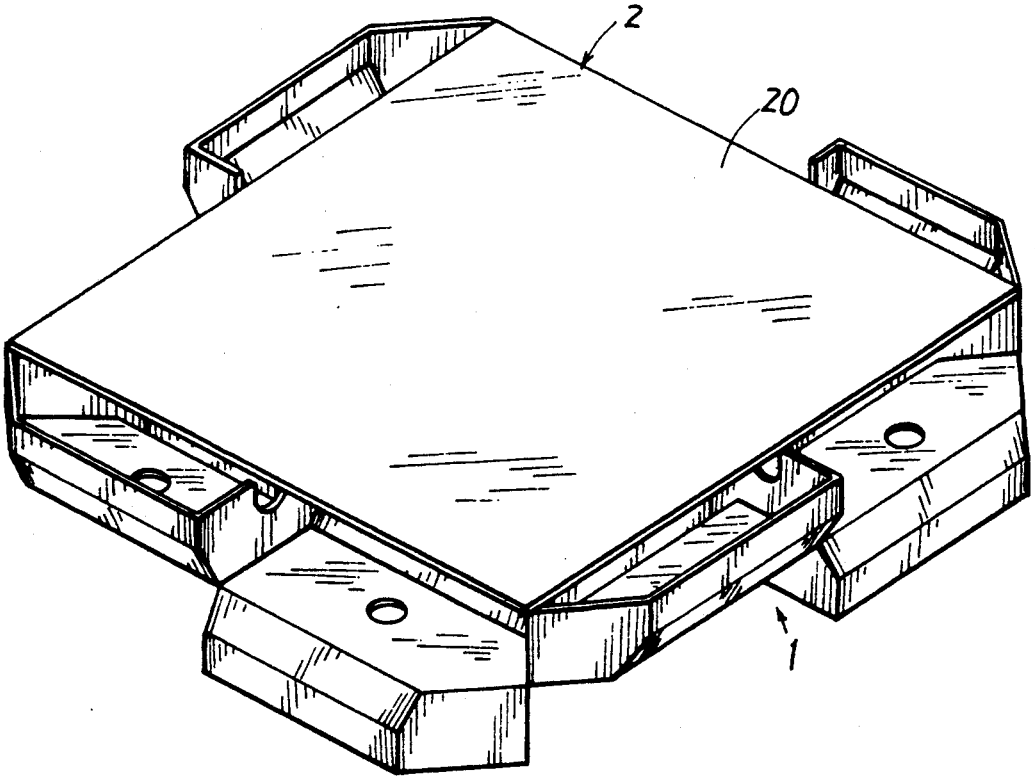
FIG. 8 is an illustraction showing an assembled block unit with a face member of the present invention.

As shown in FIG. 8 and 1 (dotted line), the flange 24 of the face member 2 will cover the block unit 1 on the four apices 123 of the four side extensions 12. The remaining portions of the side extensions 12 will be covered by the sheathing frame member 3 which will be hereinafter described with reference to FIG. 9, 10. The face plate 20 defined within the square extension 21 may be made as void for mounting other office furniture, box, or decorative article (not shown) for interior upholstery.

Figure 6:
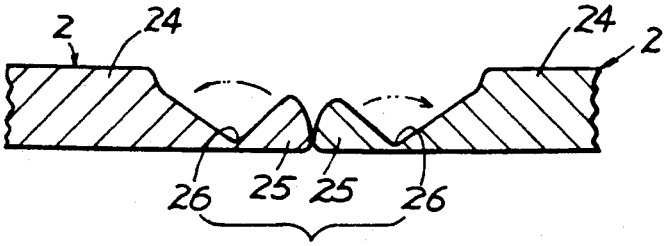
FIG. 6 is a partial sectional drawing showing two face members approximated with each other in accordance with the present invention.
Figure 7:
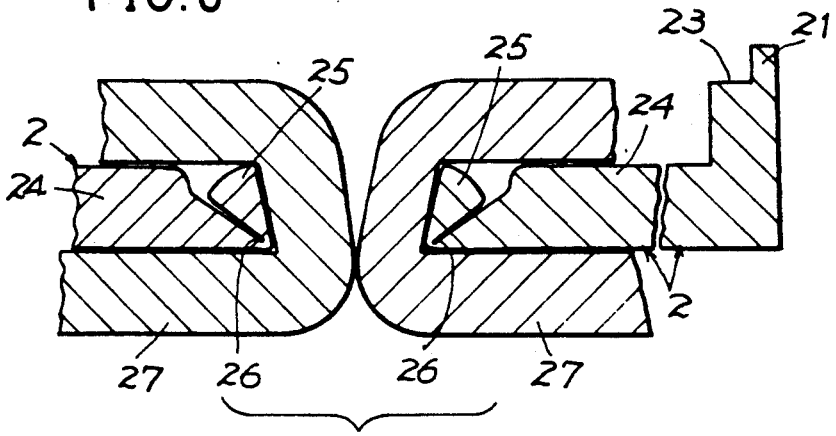
FIG. 7 shows two adjacent face members coated with finishing material.

On the bottom portion of the square extension 21, there is provided a low extension 23 around the square extension overlain on the side walls 111 to provide an aperture of thickness for coating finishing material 27 such as leather, plastic coating, etc. on the face plate 20 as shown in FIG. 7. The outermost edge 25 of the face plate 20 is formed with a hinge portion 26, which edge 25 will approximate to any adjacent face member 2 as shown in FIG. 6 to be free of aperture therebetween. After being coated with finishing material 27, the hinge portion 26 may be bent to provide an aperture for the thickness of the finishing material coated on the plate 20 as shown in FIG. 7.

Figure 9:
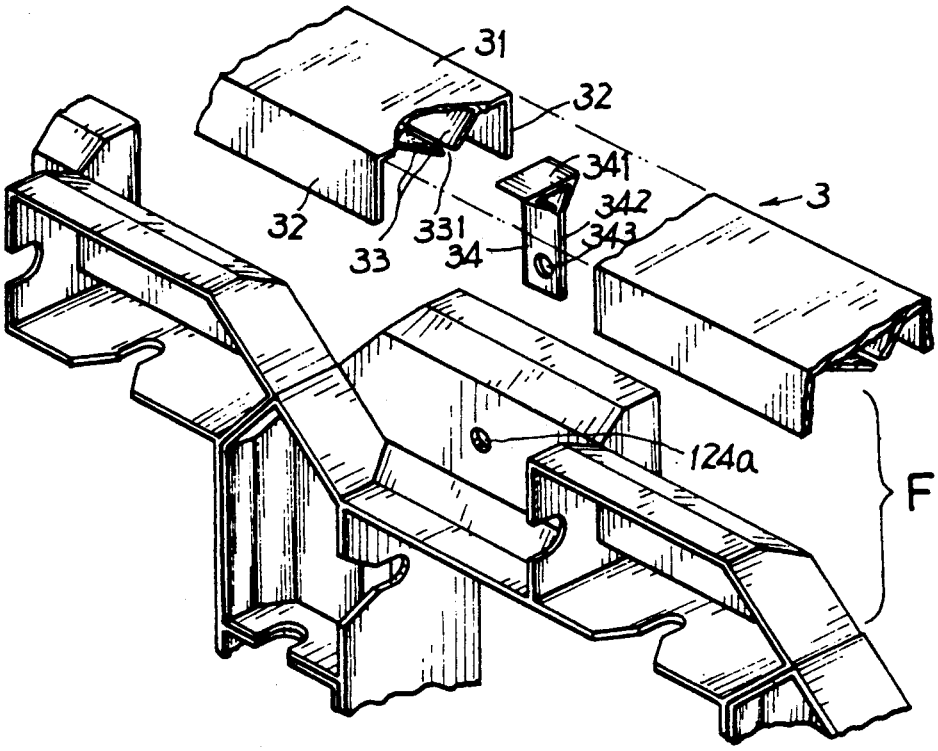
FIG. 9 is an illustration showing a sheating frame member for covering side extensions of the block units of the present invention.
Figure 10:
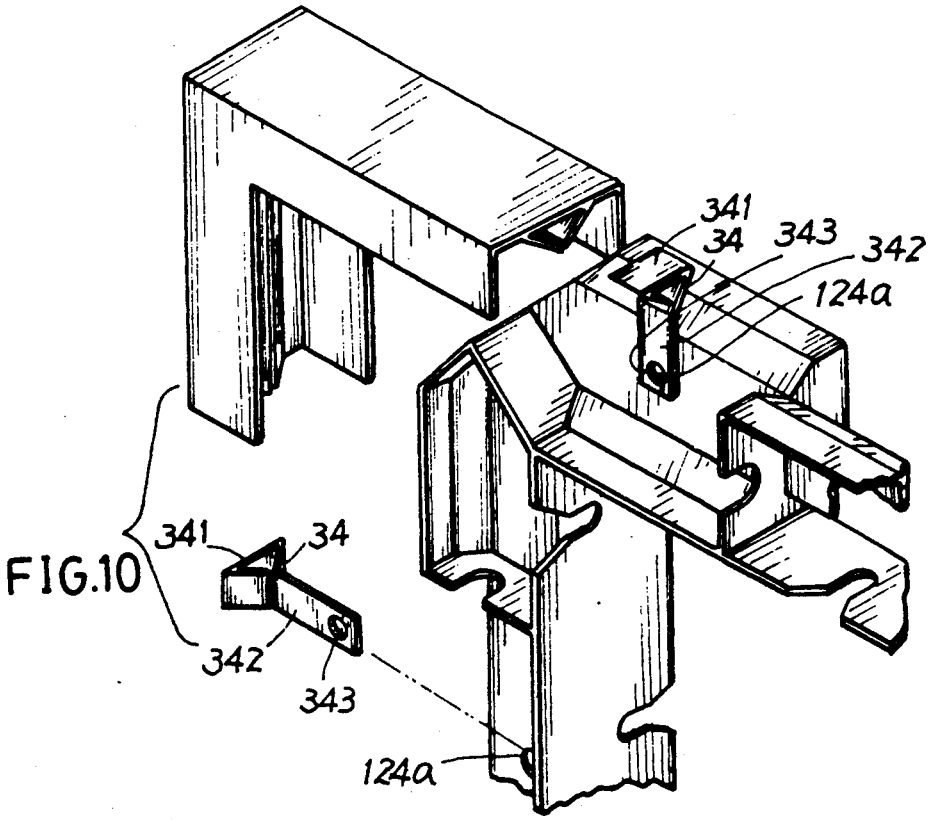
FIG. 10 shows a further example for securing the frame member with the block unit of the present invention.

The sheathing frame member 3 as shown in FIGS. 9, 10 includes a longitudinal sheath 30 shaped as an inversed U shape of its cross section having a base plate 31, two side plates 32 protruding from the base plate 31 and perpendicular to the edge plate 31, a triangular guide 33 formed inside the base plate 31 having a longitudinal slit 331 formed in a central portion of the guide 33; and a fixing bracket 34 having a triangle head portion 341 slidably engageable with the triangular guide 33, a fixing plate 342 protruding from the triangle head portion 341 formed with a hole 343 therein so that a bolt is inserted through the hole 343 and a hole 124*a* formed in the block unit 1 for fixing the bracket 34 on the block unit 1 so as to fix the frame member 3 on the block unit 1 by slidably engaging the triangular guide 33 with the triangle head portion 341 by passing the fixing plate 342 through the slit 331 of the triangular guide 33. As shown in FIG. 10, the frame member 3 may also be modified as an elbow type for sheathing a corner portion of the assembled block units.

Figure 11:
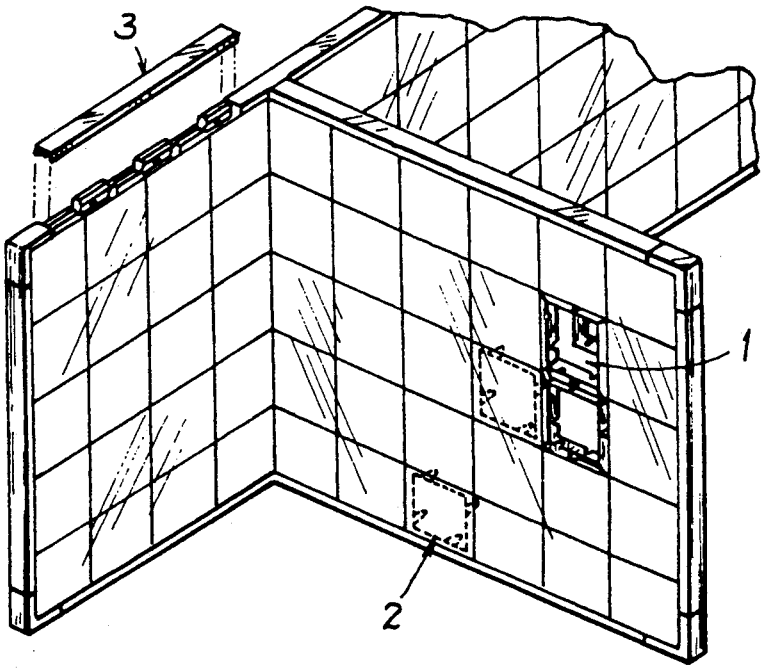
FIG. 11 is a perspective view showing an assembled partition in accordance with the present invention.

As shown in FIG. 11, an overall partition is assembled for use in an office upholstery, an exhibition ground, a display center, or a partition system for family or public use.

The present invention has the following advantages superior to any conventional partition wall means:

1. All block units 1 can be optionally or selectively assembled from any two adjacent units from any direction for any desired structure, shape, configuration for diversified purposes. Such a flexible arrangement is suitable for office automation in modern age.

2. Each face member 2 may be formed with decorative finishing, or made as optical transmissive, or even excavated for further putting a small box or decorative article therein, especially beneficial for interior upholstery or office decoration.

3. All units or basic members of this invention may be integrally made such as by plastic molding or extrusion processes, suitable for mass production with a cheaper cost and also for easier installation and minor maintenance problems.

We claim:

1. A flexible assembling partition means comprising:

a plurality of octagonal block units assembled with one another, each octagonal block unit being embedded with a face member therein, and at least a sheathing frame member for covering a plurality of side portions of assembled octagonal block units, characterized in that:

each side octagonal block unit includes a central square portion having four side walls for forming a square and defining a central square hole within said side walls, a plurality of side extensions and recesses circumferentially formed on all said side walls of said central square portion, each said recess following each said side extension, one said side extension of one said block unit being engageable with any adjacent said recess of another block unit for coupling two said block units;

said face member including a face plate operatively shielding each said block unit, a square extension formed on a central inside surface of said face plate engageable with all said side walls of said central square portion of said block unit for embedding said face member in said block unit; and said sheathing frame member generally formed as a longitudinal sheath having a cross section of inversed U shape for covering all said side extensions of said block units.

2. A partition means according to claim 1, wherein said side walls of said block unit are formed with a plurality of notches for engaging a plurality of lugs protruding from a square extension of said face member for securing said face member with said block unit.

3. A partition means according to claim 1, wherein said face member is formed with a transparent sheet for optical transmissive purpose.

4. A partition means according to claim 1, wherein said side extension and said recess are respectively formed on a half height of a total height of each said side wall of said square portion so as to form an upper side extension, an upper recess relative to a lower side extension and a lower recess.

5. A partition means according to claim 4, wherein said upper side extension is interlaced to said lower side extension, whereas said upper recess is interlaced to said lower recess so that two block units can be assembled with each other from any orientation.

6. A partition means according to claim 1, wherein said face member further includes a square flange laterally extending from the square extension on said face plate, having a hinge portion formed between an outermost edge portion of the face plate and the square flange, so that a finishing material can be coated on said face plate and said square flange by bending said hinge portion of said square flange.

7. A partition means according to claim 6, wherein a low extension is disposed around the square extension formed on the central portion of said face plate of said face member, overlain on said side walls of said block unit for providing an aperture allowing a thickness of the coated finishing material on said face plate.

8. A partition means according to claim 1, wherein said sheathing frame member includes a longitudinal sheath having a cross section of inversed U shape for covering the side portions of the block units assembled together, and a fixing bracket fixed on each said block unit slidably engageable with said sheath for mounting said frame member onto said block units.

9. A partition means according to claim 8, wherein said longitudinal sheath includes a triangular guide formed on an inside surface of said frame member having a longitudinal slit formed in said guide for slidably passing a fixing plate of said fixing bracket, said fixing bracket having a fixing plate protruding from a triangle head portion of said fixing bracket to be fixed on said block unit, said triangle head portion slidably engageable with said triangular guide of said sheath.

10. A partition means according to claim 1, wherein each said side extension of said block unit includes a hollow portion, a side wall plate parallel to said side wall of said square portion, a right-angled triangle portion formed on a right-angle portion of the square portion, a bottom plate having a horizontal surface formed on a bottom surface of said bottom plate, and a partition plate formed on a central portion of the side wall, all said right-angled triangle portions of all said side extensions shaped as arrow directions orienting clockwise about a diagonal center of said square portion of said block unit, each said side extension having a dimension equivalent to each said recess.

11. A partition means according to claim 10, wherein each said side extension is formed with a hole in the bottom plate for fixing a bolt therethrough for coupling another block unit, and is formed with another hole in said partition plate for passing cable or wire as used in an office.

12. A partition means according to claim 10, wherein each said side extension includes a sloping plate intersecting the side wall plate and the bottom plate of said side extension, engageable with another sloping surface formed on said recess.

* * * * *